US008166852B2

(12) United States Patent
Cheng

(10) Patent No.: US 8,166,852 B2
(45) Date of Patent: May 1, 2012

(54) RATCHET WRENCH

(76) Inventor: Ming-Ta Cheng, Miaoli Hsien (TW)

( * ) Notice: Subject to any disclaimer, the term of this patent is extended or adjusted under 35 U.S.C. 154(b) by 412 days.

(21) Appl. No.: 12/586,520

(22) Filed: Sep. 23, 2009

(65) Prior Publication Data

US 2011/0067534 A1 Mar. 24, 2011

(51) Int. Cl.
*B25B 23/145* (2006.01)

(52) U.S. Cl. ..... 81/467; 81/52; 81/470

(58) Field of Classification Search ..... 81/52, 467, 81/470

See application file for complete search history.

(56) References Cited

U.S. PATENT DOCUMENTS

| | | | | |
|---|---|---|---|---|
| 5,201,255 | A * | 4/1993 | Gegg | 81/57.29 |
| 2008/0190247 | A1* | 8/2008 | Liaw | 81/57.29 |
| 2009/0165609 | A1* | 7/2009 | Cho et al. | 81/470 |

* cited by examiner

*Primary Examiner* — Lee D Wilson
*Assistant Examiner* — Shantese McDonald
(74) *Attorney, Agent, or Firm* — William E. Pelton, Esq.; Cooper & Dunham LLP

(57) ABSTRACT

A ratchet wrench has a handle, a transmitting device, a torque adjusting device and a ratchet head. The transmitting device is connected to the handle and has a barrel, a transmitting seat and a transmitting shaft. The barrel is connected to the handle and has two threaded segments and multiple elongated holes. The transmitting shaft is rotatably mounted in the barrel and has a driving disk and an eccentric rod. The torque adjusting device is connected to the transmitting device and has a casing, a limiting assembly and a spring. The casing is connected to the barrel. The limiting assembly is mounted around the transmitting shaft and has two pressing rings and a push bearing. The spring is mounted around the transmitting shaft and presses against the pressing rings to push the holding pins abutting with the holding recess. The ratchet head is connected to the transmitting device.

10 Claims, 4 Drawing Sheets

RATCHET WRENCH

BACKGROUND OF THE INVENTION

1. Field of the Invention

The present invention relates to a ratchet wrench, and more particularly to a ratchet wrench that with adjustable torque.

2. Description of Related Art

Conventional pneumatic tools, such as ratchet wrenches are used to tighten or loosen nuts and bolts, a conventional ratchet wrench in accordance with the prior art comprises a handle, an air-inlet controlling device, a transmitting device and a ratchet head. The air-inlet controlling device is mounted in the handle to control the flow direction of compressed air and communicates with the handle. The transmitting device is mounted in the handle and is connected to the air-inlet device. The ratchet head is connected to the transmitting device to fasten or loosen nuts and bolts by changing flow direction of the compressed air by the air-inlet controlling device and the transmitting device.

Although the conventional ratchet wrench can be used to fasten or loosen the nuts and bolts, the torque force of the conventional ratchet wrench is a fixed value and can not be adjusted according to different kinds of bolts or nuts. Thus, multiple ratchet wrenches with different torque forces are needed to fasten or loosen different kinds of nuts and bolts, but this is inconvenient and costly. In addition, when changing or tightening the nuts and bolts of a vehicle wheel by the conventional ratchet wrench, which has a higher pounds of torque than that for the nuts and bolts, the nuts and bolts are easily stripped due to over-torque.

To overcome the shortcomings, the present invention tends to provide a ratchet wrench to mitigate or obviate the aforementioned problems.

SUMMARY OF THE INVENTION

The main objective of the present invention is to provide a ratchet wrench that can adjust the torque force of the ratchet wrench.

The ratchet wrench in accordance with the present invention has a handle, a transmitting device, a torque adjusting device and a ratchet head. The transmitting device is connected to the handle and has a barrel, a transmitting seat and a transmitting shaft. The barrel is connected to the handle and has two threaded segments and multiple elongated holes. The transmitting seat is mounted in the barrel. The transmitting shaft is rotatably mounted in the barrel and has a driving disk and an eccentric rod. The torque adjusting device is connected to the transmitting device and has a casing, a limiting assembly and a spring. The casing is connected to the barrel and has a holding recess and a retaining ring. The limiting assembly is mounted around the transmitting shaft and has two pressing rings and a push bearing. The spring is mounted around the transmitting shaft and presses against the pressing rings to push the holding pins abutting with the holding recess of the casing. The ratchet head is connected to the transmitting device.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
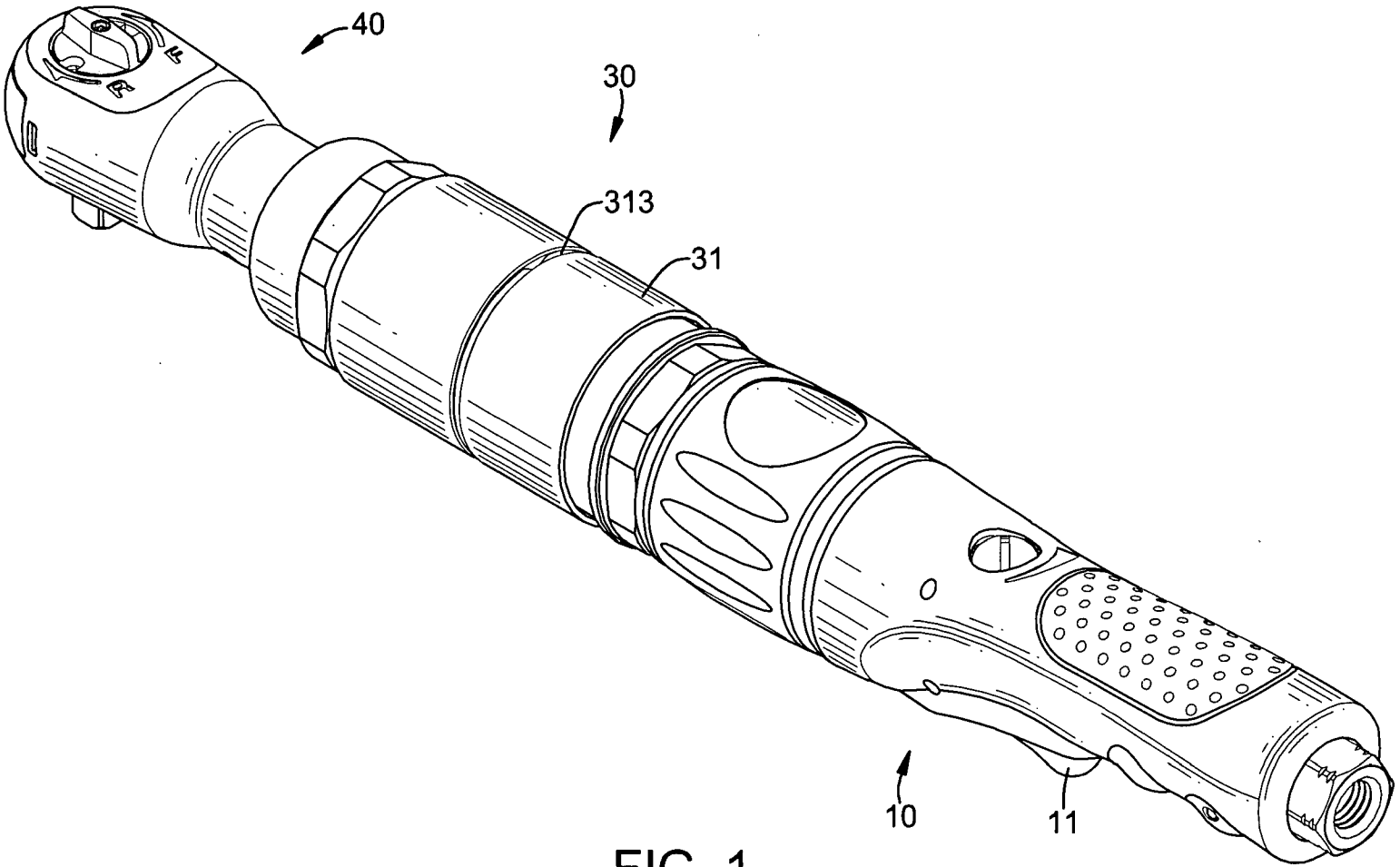
FIG. 1 is a perspective view of a ratchet wrench in accordance with the present invention.
Figure 2:
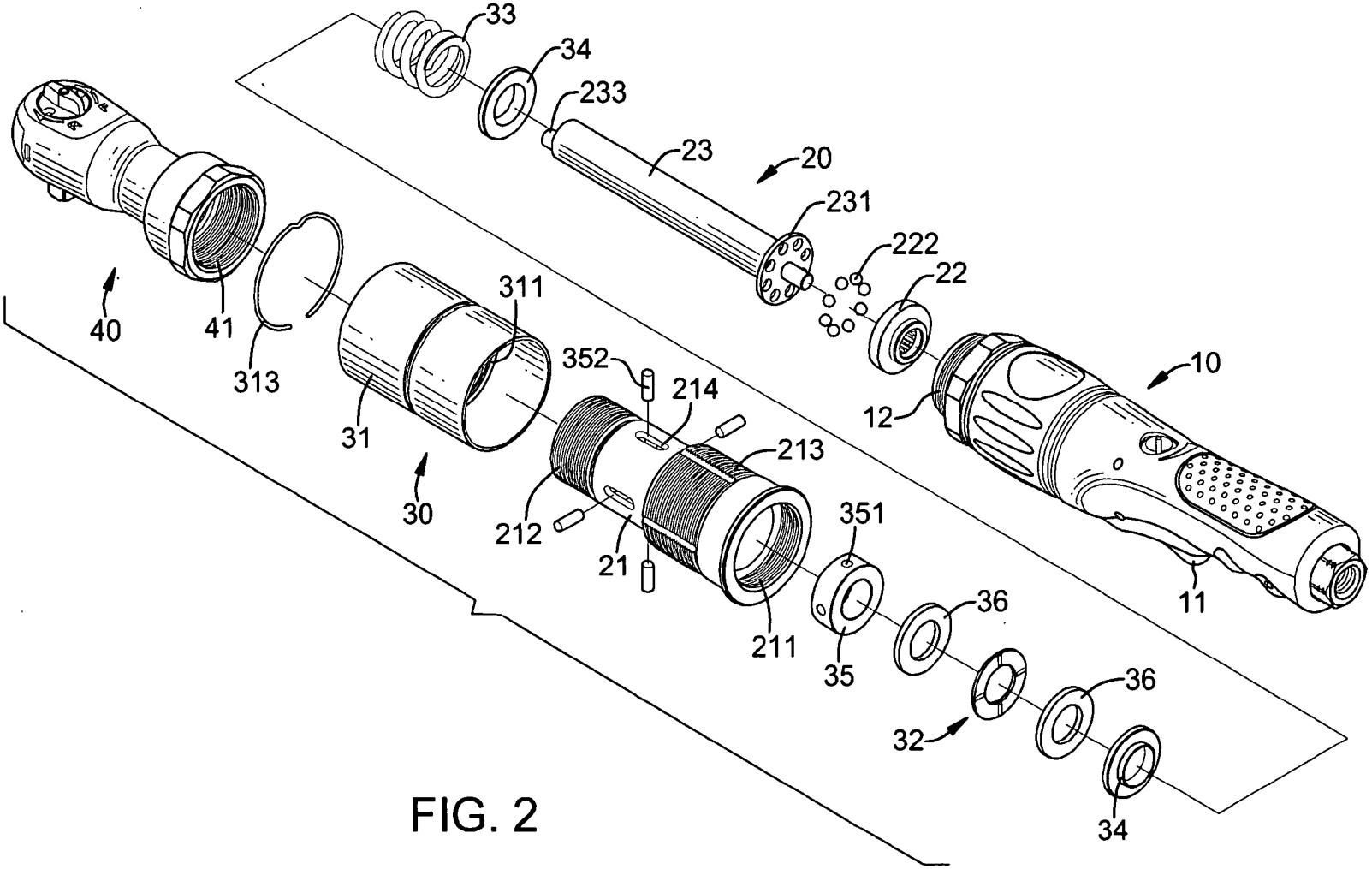
FIG. 2 is an exploded perspective view of the ratchet wrench in FIG. 1.
Figure 3:
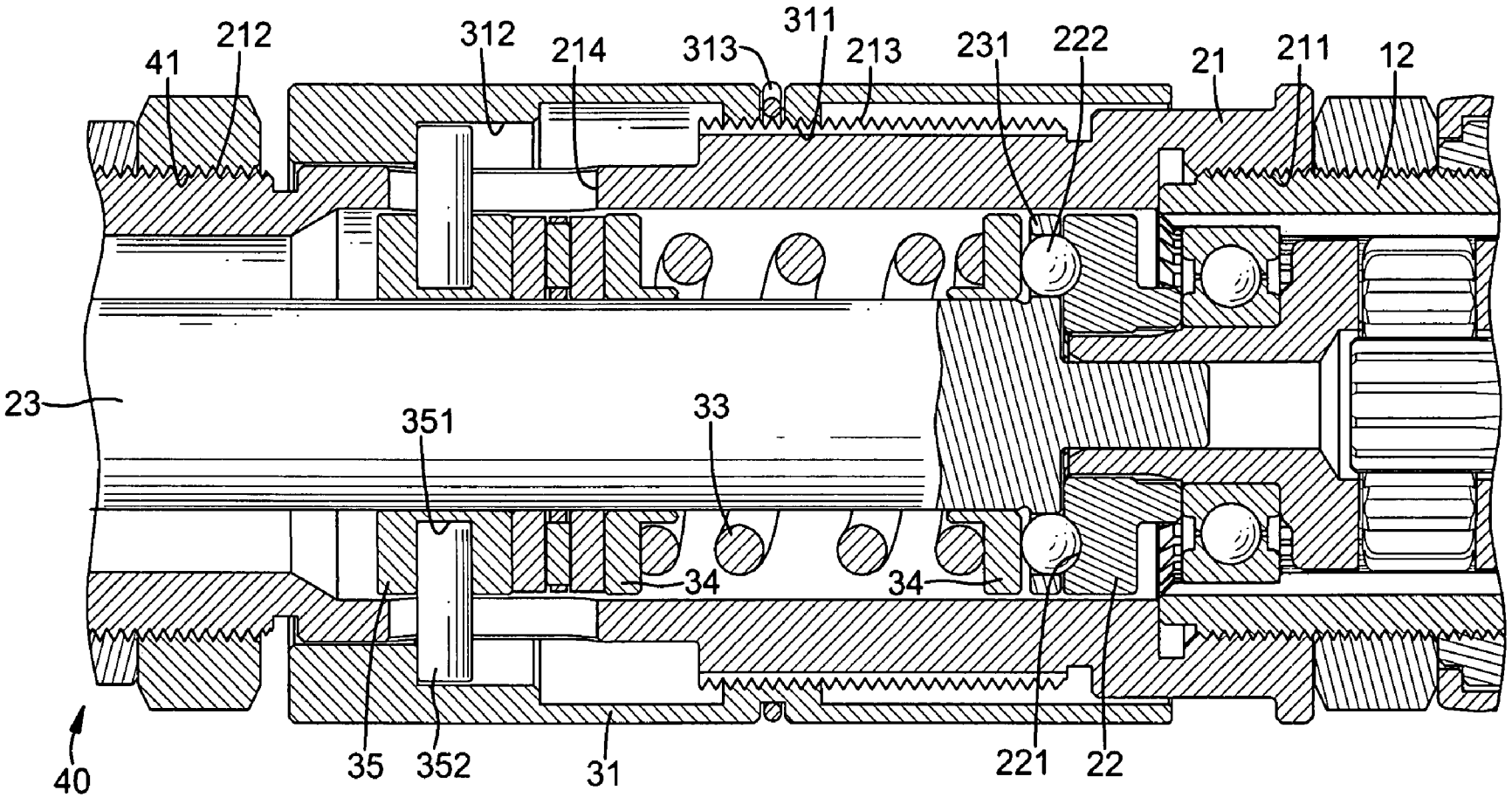
FIG. 3 is an enlarged side view in partial section of the ratchet wrench in FIG. 1.

With reference to FIGS. 1, 2 and 3, a ratchet wrench in accordance with the present invention comprises a handle (10), a transmitting device (20), a torque adjusting device (30) and a ratchet head (40).

The handle (10) has a front end, a rear end, an external surface, an air-inlet controlling device, a button (11) and a mounting tube (12). The air-inlet controlling device is mounted in the handle (10) to control the flow direction of compressed air. The button (11) is mounted on the external surface of the handle (10) near the rear end. The mounting tube (12) is axially formed on and protrudes from the front end of the handle (10) and has an outer thread.

The transmitting device (20) is connected to the handle (10) and has a barrel (21), a transmitting seat (22) and a transmitting shaft (23).

The barrel (21) is connected to the handle (10) and has a front end, a rear end, an internal surface, an external surface, an inner thread (211), a front threaded segment (212), a rear threaded segment (213) and multiple elongated holes (214). The rear end of the barrel (21) is connected to the front end of the handle (10). The inner thread (211) is formed on the internal surface of the barrel (21) and is screwed with the outer thread of the mounting tube (12) of the handle (10). The front threaded segment (212) is formed on the external surface of the barrel (21) near the front end. The rear threaded segment (213) is formed on the external surface of the barrel (21) near the rear end. The elongated holes (214) are radially formed through the barrel (21) at intervals between the threaded segments (212, 213).

The transmitting seat (22) is mounted in the barrel (21) near the rear end, is connected to the air-inlet controlling device of the handle (10) and has a front side, multiple ball recesses (221) and multiple balls (222). The ball recesses (221) are formed in the front side of the transmitting seat (22). The balls (222) are rotatably mounted in the ball recesses (221) of the transmitting seat (22).

The transmitting shaft (23) is rotatably mounted in the barrel (21), is connected to the transmitting seat (22) and has a rear end, a front end, a driving disk (231) and an eccentric rod (233). The driving disk (231) is formed around the transmitting shaft (23) near the rear end, faces to the ball recesses (221) of the transmitting seat (22) and has multiple ball holes (232). The ball holes (232) are formed through the driving disk (231) and are mounted around the balls (222) of the transmitting seat (22). The eccentric rod (233) is eccentrically formed on and protrudes from the front end of the transmitting shaft (23).

The torque adjusting device (30) is connected to the transmitting device (20) and has a casing (31), a limiting assembly (32) and a spring (33).

The casing (31) is connected to the barrel (21) of the transmitting device (20) and has an internal surface, a front end, a rear end, a middle, an inner thread (311), a holding recess (312) and a retaining ring (313). The inner thread (311) is formed on the internal surface of the casing (31) near the middle and is screwed with the rear threaded segment (213) of the barrel (21). Accordingly, the casing (31) can be rotated relative to the barrel (21) by engagement between the inner thread (311) and the rear threaded segment (213). The holding recess (312) is formed in the internal surface of the casing (31) near the front end and faces to the elongated holes (214) of the barrel (21). The retaining ring (313) is mounted around the casing (31) near the middle.

The limiting assembly (32) is mounted around the transmitting shaft (23) and has two pressing rings (34), a push bearing (35) and multiple washers (36). The pressing rings (34) are movably mounted around the transmitting shaft (23). One of the pressing rings (34) abuts with the balls (222) of the transmitting seat (22) and the other pressing ring (34) is mounted on the transmitting shaft (23) near the elongated holes (214) of the barrel (21). The push bearing (35) is movably mounted around the transmitting shaft (23) near the holding recess (312) of the casing (31) and has an external surface, multiple mounting recesses (351) and multiple holding pins (352). The mounting recesses (351) are radially formed in the external surface of the push bearing (35) at intervals and align respectively with the elongated holes (214) of the barrel (21). The holding pins (352) are respectively mounted in the mounting recesses (351) of the push bearing (35), extend out of the elongated holes (214) of the barrel (21) and press against the internal surface the casing (31) near the holding recess (312). The washers (36) are mounted around the transmitting shaft (23) between the pressing rings (34) and the push bearing (35).

The spring (33) is mounted around the transmitting shaft (23) and presses against the pressing rings (34) to push the holding pins (352) abutting with the internal surface of the casing (31) near the holding recess (312).

The ratchet head (40) is connected to the transmitting device (20) and has a rear end, a front end, an inner thread (41) and a ratchet wheel. The rear end of the ratchet head (40) is connected to the front end of the barrel (21). The inner thread (41) is formed in the ratchet head (40) at the rear end and is screwed with the front threaded segment (212) of the barrel (21). The ratchet wheel is mounted in the ratchet head (40) near the front end and is connected to the eccentric rod (233) of the transmitting shaft (23).

Figure 4:
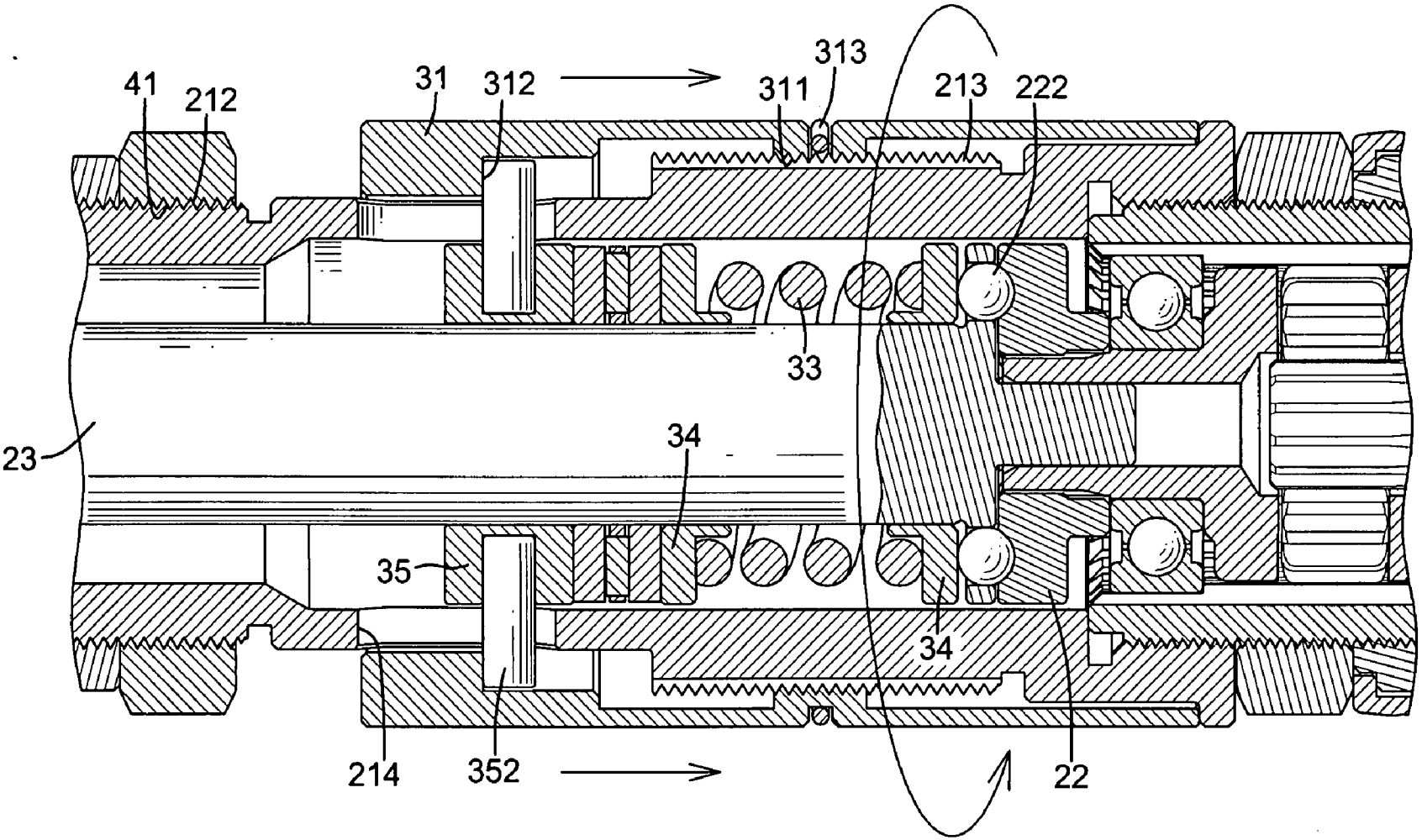
FIG. 4 is an enlarged operational side view in partial section of the ratchet wrench in FIG. 1.

With reference to FIGS. 2 and 4, when the ratchet wrench of the present invention is used to tighten or loosen nuts or bolts, the casing (31) is rotated and moved relative to the barrel (21) by the engagement between the inner thread (311) of the casing (31) and the rear threaded segment (213) of the barrel (21). When the casing (31) is rotated relative to the barrel (21), the holding recess (312) of the casing (31) will push the holding pins (352) of the push bearing (35) to move relative to the elongated holes (214) of the barrel (21) and the push bearing (35) will be moved relative to the transmitting shaft (23). When the push bearing (35) is moved with the casing (31) relative to the transmitting shaft (23), the spring (33) will be compressed or extended between the pressing rings (34) and this will change the pressing force applied to the balls (222) via the pressing ring (34) that abuts with the driving disk (231). When the pressing force applied to the balls (222) is changed, the torque force of the transmitting shaft (23) will be adjusted according to the pressing force applied to the balls (222) of the transmitting seat (22). Therefore, the torque force of the ratchet wrench is adjustable by rotating the casing (31) of the torque adjusting device (30) relative to the barrel (21) of the transmitting device (20).

Consequently, when using the ratchet wrench in accordance with present invention to tighten the nuts or bolts, pounds of torque provided by the ratchet wrench can be adjusted to be lower than that applied for the nuts and bolts by rotating the casing (31) of the torque adjusting device (30) relative to the barrel (21) of the transmitting device (20). Accordingly, the nuts and bolts will not be over-torqued and stripped.

Even though numerous characteristics and advantages of the present invention have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A ratchet wrench having
- a handle having
  - a front end;
  - a rear end;
  - an external surface; and
  - an air-inlet controlling device mounted in the handle to control the flow direction of a compressed air;
- a transmitting device connected to the handle and having
  - a barrel connected to the handle and having
    - a front end;
    - a rear end connected to the front end of the handle;
    - an internal surface;
    - an external surface;
    - a front threaded segment formed on the external surface of the barrel near the front end;
    - a rear threaded segment formed on the external surface of the barrel near the rear end; and
    - multiple elongated holes radially formed through the barrel at intervals between the threaded segments;
  - a transmitting seat mounted in the barrel near the rear end and connected to the air-inlet controlling device of the handle; and
  - a transmitting shaft rotatably mounted in the barrel, connected to the transmitting seat and having
    - a rear end;
    - a front end;
    - a driving disk formed around the transmitting shaft near the rear end and facing to the transmitting seat; and
    - an eccentric rod eccentrically formed on and protruding from the front end of the transmitting shaft;
- a torque adjusting device connected to the transmitting device and having
  - a casing connected to the barrel of the transmitting device and having
    - an internal surface;
    - a front end;
    - a rear end;
    - a middle;
    - an inner thread formed on the internal surface of the casing near the middle and screwed with the rear threaded segment of the barrel; and
    - a holding recess formed in the internal surface of the casing near the front end and facing to the elongated holes of the barrel;
  - a limiting assembly mounted around the transmitting shaft and having
    - two pressing rings movably mounted around the transmitting shaft, one of the pressing rings abutting with the balls of the transmitting seat and the other pressing ring mounted on the transmitting shaft near the elongated holes of the barrel; and a push bearing movably mounted around the transmitting shaft near the holding recess of the casing and having an external surface;

multiple mounting recesses radially formed in the external surface of the push bearing at intervals and aligning respectively with the elongated holes of the barrel; and multiple holding pins respectively mounted in the mounting recesses of the push bearing, extending out of the elongated holes of the barrel and pressed against the internal surface of the casing near the holding recess; and a spring mounted around the transmitting shaft and pressed against the pressing rings to push the holding pins abutting with the internal surface of the casing near the holding recess; and a ratchet head connected to the transmitting device and having a rear end connected to the front end of the barrel; and a front end.

2. The ratchet wrench as claimed in claim 1, wherein the transmitting seat has a front side;

multiple ball recesses formed in the front side of the transmitting seat; and multiple balls rotatably mounted in the ball recesses of the transmitting seat; and the driving disk faces to the ball recesses of the transmitting seat and has multiple ball holes formed through the driving disk and mounted around the balls of the transmitting seat.

3. The ratchet wrench as claimed in claim 2, wherein the handle has a mounting tube axially formed on and protruding from the front end of the handle and having an outer thread; and the barrel has an inner thread formed on the internal surface of the barrel and screwed with the outer thread of the mounting tube of the handle.

4. The ratchet wrench as claimed in claim 3, wherein the casing has a retaining ring mounted around the casing near the middle.

5. The ratchet wrench as claimed in claim 4, wherein the limiting assembly has multiple washers mounted around the transmitting shaft between the pressing rings and the push bearing.

6. The ratchet wrench as claimed in claim 5, wherein the ratchet head has an inner thread formed in the ratchet head at the rear end and screwed with the front threaded segment of the barrel.

7. The ratchet wrench as claimed in claim 6, wherein the handle has a button mounted on the external surface of the handle near the rear end.

8. The ratchet wrench as claimed in claim 1, wherein the casing has a retaining ring mounted around the casing near the middle.

9. The ratchet wrench as claimed in claim 1, wherein the limiting assembly has multiple washers mounted around the transmitting shaft between the pressing rings and the push bearing.

10. The ratchet wrench as claimed in claim 1, wherein the ratchet head has an inner thread formed in the ratchet head near the rear end and screwed with the front threaded segment of the barrel.

* * * * *